United States Patent [19]

Lilja

[11] 3,937,253

[45] Feb. 10, 1976

[54] MULTIPLE FLUID DISPENSING APPARATUS

[76] Inventor: Duane F. Lilja, 2410 Central Ave. NE., Minneapolis, Minn. 55418

[22] Filed: Oct. 11, 1974

[21] Appl. No.: 514,001

Related U.S. Application Data

[63] Continuation-in-part of Ser. No. 413,768, Nov. 8, 1973, Pat. No. 3,841,555, which is a continuation-in-part of Ser. No. 280,476, Aug. 14, 1972, Pat. No. 3,780,943.

[52] U.S. Cl. ..... 137/625.18; 137/625.5; 137/597

[51] Int. Cl.[2] ..... A16R 11/07

[58] Field of Search..... 137/625.5, 625.18, 628, 137/625.12, 595, 597, 609, 612.1; 222/129, 136, 484, 485, 470, 511; 239/417.5, 526, 528

[56] References Cited

UNITED STATES PATENTS

| | | | |
|---|---|---|---|
| 1,232,618 | 7/1917 | Smart | 239/528 X |
| 1,382,640 | 6/1921 | Heinrich | 239/528 X |
| 1,815,474 | 7/1931 | Hickman | 137/625.18 X |
| 3,352,333 | 11/1967 | Glasgow et al. | 239/528 X |
| 3,460,577 | 8/1969 | Weathers | 137/625.69 |
| 3,487,435 | 12/1969 | Sheardown | 137/625.18 X |
| 3,542,065 | 11/1970 | Holbrook | 137/625.69 X |
| 3,812,883 | 5/1974 | Yokokawa | 137/625.69 |

*Primary Examiner*—Martin P. Schwadron
*Assistant Examiner*—Robert J. Miller
*Attorney, Agent, or Firm*—Burd, Braddock & Bartz

[57] ABSTRACT

An apparatus for simultaneously, separately dispensing a multiple of fluids. The apparatus includes a chamber with a plurality of fluid inlets and a fluid outlet corresponding to each fluid inlet. A plunger is linearly movable in the chamber and has a plurality of spaced apart heads movable into blocking relationship between corresponding fluid inlet and outlet ports, and out of blocking relationship between corresponding fluid inlet and outlet ports to provide isolated fluid passages through the apparatus between corresponding inlet and outlet ports allowing coordinated movement of a plurality of different fluids through the apparatus. The heads and ports may be relatively sized and spaced to provide either simultaneous initiation and termination of multiple fluid discharge or staged initiation and termination of fluid discharge.

12 Claims, 6 Drawing Figures

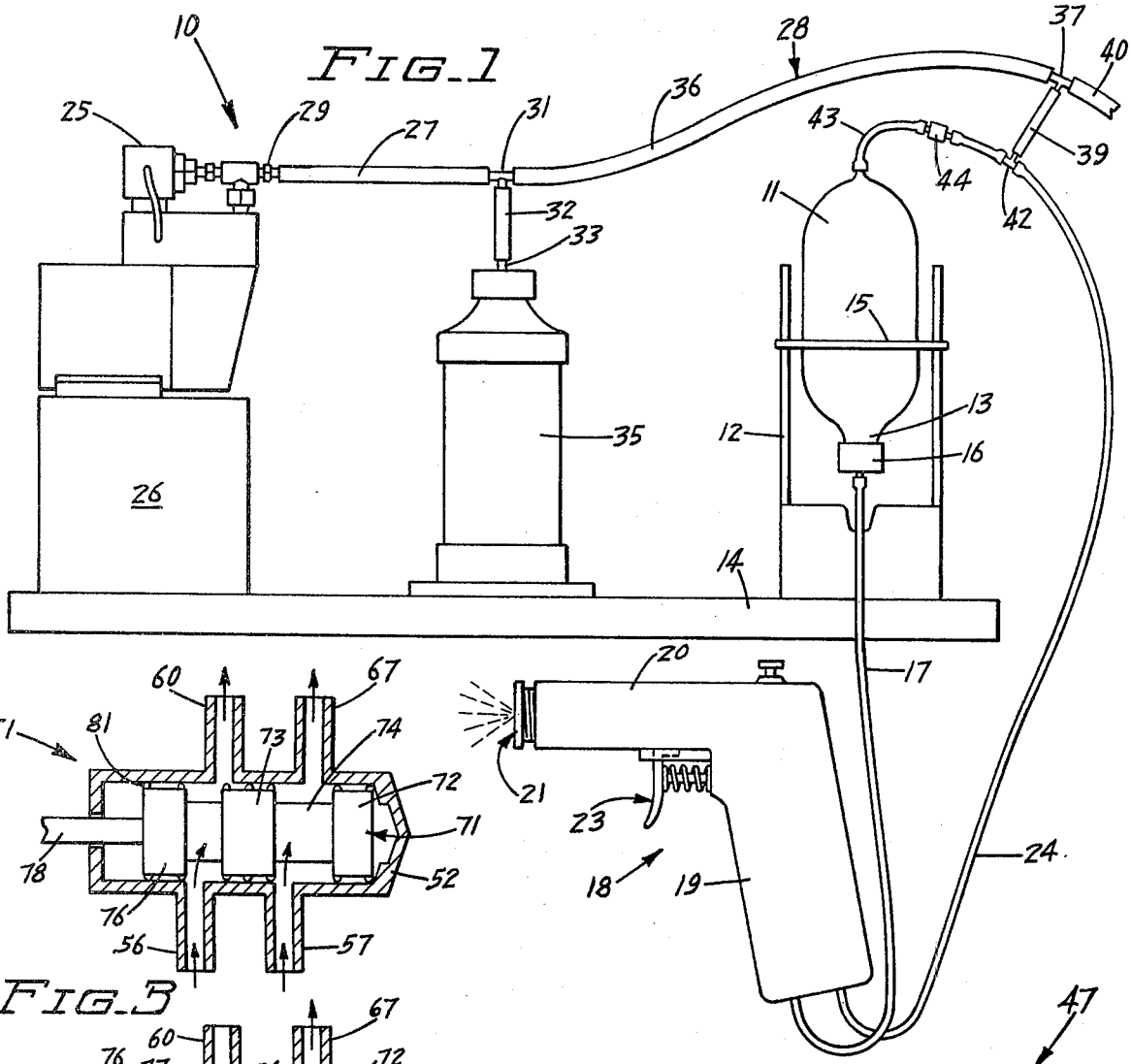
FIG. 1
10
25
29
27
31
36
28
37
40
39
43
44
42
11
32
33
15
13
16
12
35
26
14
17
20
21
23
18
19
24
FIG. 3
51
60
67
81
73
74
72
71
78
76
52
56
57
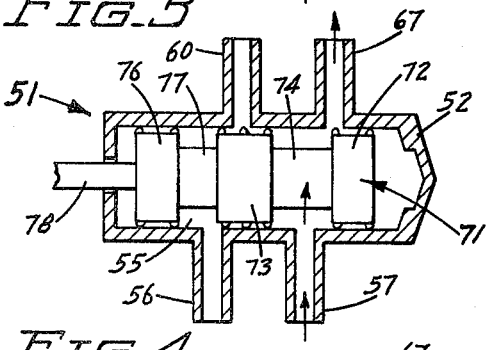
FIG. 4
51
60
67
76
77
74
72
52
78
71
55
73
56
57
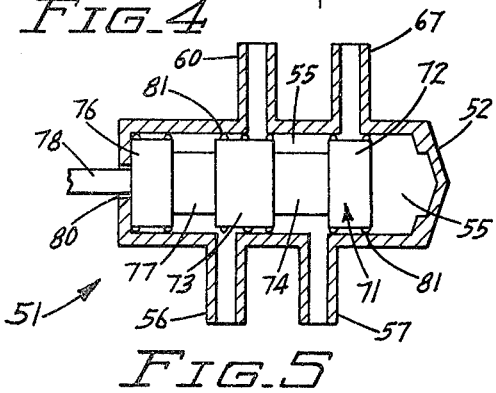
FIG. 5
51
60
67
81
55
72
76
52
78
80
55
77
73
74
71
81
56
57
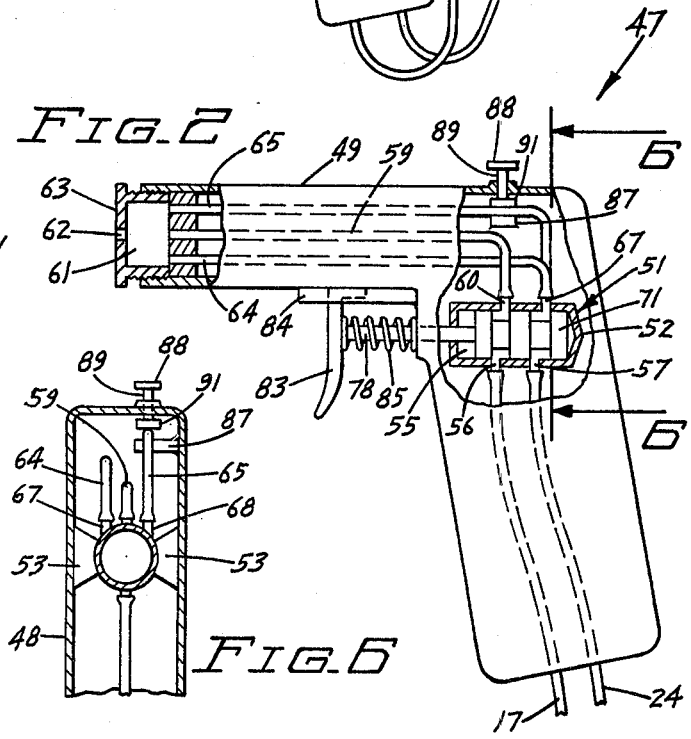
FIG. 2
47
65
49
59
89
88
91
6
63
62
61
87
67
51
60
71
52
64
84
57
83
78
85
55
56
6
17
24
FIG. 6
89
88
91
59
87
64
65
67
68
53
53
48

MULTIPLE FLUID DISPENSING APPARATUS

CROSS REFERENCE TO RELATED APPLICATION

This application is a continuation-in-part of U.S. Pat. application Ser. No. 413,768, filed Nov. 8, 1973, now U.S. Pat. No. 3,841,555. U.S. Pat. No. 3,841,555 is a continuation-in-part of Ser. No. 280,476 filed Aug. 14, 1972, now U.S. Pat. No. 3,780,943.

BACKGROUND OF THE INVENTION

Many apparatus require systems for the coordinated, simultaneous discharged of two or more fluids for mixing thereof outside of the apparatus. For example, a spray apparatus may require a system for the mixture of a gas and a spray product outside of the spray apparatus. Beverage dispensing machines may require the mixture of two fluids such as a soft drink syrup and carbonated water, or coffee and cream. Additional such apparatus requiring the mixture of fluids in either gaseous or liquid state include acetylene torch systems, apparatus for mixing of various resins to form plastics or adhesives, and many more. Such apparatus require separate fluid conduits through the apparatus for conducting the fluids to the point of mixture outside of the apparatus. The fluids are either separately valved through the apparatus or involve relative complex valving or nozzle mechanisms to simultaneously transmit the fluids through the apparatus through separate conduits.

SUMMARY OF THE INVENTION

The invention relates to a multiple fluid dispensing apparatus for use in providing a coordinate or programmed discharge of two or more fluids for mixture of the fluids outside of the apparatus. The apparatus includes a casing which is preferably cylindrical to define a cylindrical chamber. A plurality of fluid inlets enter the chamber. A fluid outlet from the chamber corresponds to each fluid inlet. A plunger is linearly movable in the chamber parallel to the longitudinal axis of the chamber. The plunger has a plurality of spaced apart heads which make sealing engagement with the side walls of the chamber. The heads are movable into and out of blocking relationship between corresponding fluid inlet and outlet ports. In blocking relationship to the fluid inlet and outlet ports, the heads prevent fluid flow through the valve. Out of blocking relationship between the fluid inlet and outlet ports, the heads provide isolated fluid passages between corresponding inlet and outlet ports to permit isolated flow of the various fluids through the apparatus for mixing outside thereof. The fluid dispensing coordination is determined by the relative sizing and spacing of the heads and various ports. The apparatus may be coordinated to simultaneously initiate and terminate fluid flow through the various ports, or to sequentially initiate and terminate fluid flow through the various ports.

An object of the invention is to provide an apparatus for coordinated dispensing of a multiple of fluids. A second object of the invention is to provide such an apparatus having a plurality of isolated fluid conduits for isolated passage of differing fluids through the apparatus for mixing outside thereof. A further object of the invention is to provide such an apparatus having a plunger movably located in a chamber having portions movable into and out of blocking relationship between corresponding inlet and outlet ports. Further objects of the invention will become apparent upon the following description.

IN THE DRAWINGS

FIG. 1 is a schematic view of a spray apparatus incorporating a spary applicator using fluid dispensing apparatus according to the present invention;

FIG. 2 is a side elevational view of a spray applicator having a dispensing apparatus according to the present invention, partly sectioned for illustration;

FIG. 3 is a schematic view of a dispensing apparatus of the applicator of FIG. 2 in a fully open position;

FIG. 4 is a schematic view of the dispensing apparatus of FIG. 3 in an intermediately open position;

FIG. 5 is a schematic view of the dispensing apparatus of FIG. 3 in a fully closed position; and FIG. 6 is a sectional view taken along the line 6–6 of FIG. 2.

DESCRIPTION OF PREFERRED EMBODIMENT

Among the diverse applications of the multiple fluid dispensing apparatus according to the present invention is its use in a spray applicator of a spray system of the type described herein. Referring to the drawings, there is shown in FIG. 1 a spray system, indicated generally at 10. Spray system 10 is of the type described and claimed in U.S. Pat. No. 3,841,555, from which the present application in derived. A spray product reservoir 11 is supported by a stand or holder 12 on a surface 14 and is secured in place by appropriate strap 15. Container 11 stores or contains a liquid spray product, for example, a hair spray for use as a hair fixative in a beauty salon. A lower, necked-in portion 13 of container 11 is closed and sealed by suitable closure means 16. One end of a flexible, hollow, tubular spray product line 17 connects with an outlet of container 11 at closure means 16 as by engaging a hollow needle (not shown) inserted through closure means 16.

A spray applicator or spray gun 18 employs an apparatus of the present invention to concurrently discharge first and second fluids such as a spray product and air under pressure upon a surface to be sprayed. Spray gun 18 includes the usual base or handle 19 and a forwardly projecting barrel 20 terminating in an appropriate spray nozzle 21. A trigger 23 is movably mounted to the handle 19 of the gun. The product supply line 17 and the end of an applicator air supply line 24 extend through the bottom of handle 19 upwardly to barrel section 20.

Gas or air supply means includes an air compressor 25 shown supported on a suitable stand 26. A first section 27 of a main air line 28 extends from the air discharge 29 of compressor 25 to a first T connector 31. The perpendicular leg of the T connector 31 connects through a tubular branch 32 to an inlet 33 of an air pressure accumulator 35. Pressure accumulator 35 comprises a closed, empty container or vessel providing a sealed volume where air under pressure is accumulated for use when the air compressor 25 is shut off. Compressor 25 is of the variety equipped with a standard pressure switching mechanism whereby the compressor 25 is energized when the line pressure drops to a predetermined level or low limit, and shuts off when the line pressure has been raised to a second predetermined level or high limit. Compressor 25 provides pressurized air to applicator 18 and at the same time pressurizes accumulator 35.

A second section 36 of the main air supply line 28 extends from the first T connector to a second T connector 37. A connecting tube 39 extends from the perpendicular leg of the second T connector 37 to provide air under pressure from main air supply line 28 to the container 11 and spray gun 18 of the spray system. The main air supply line 28 continues from the second T connector 37, as at 40, where it may be extended to additional spray systems connected in series, as, for example, in a beauty salon where there may be a plurality of stations, each having a separate spray product reservoir and spray applicator.

Connecting tube 39 extends from the second T connector 37 to the perpendicular leg of a third T connector 42. A reservoir air pressure supply branch 43 extends from one of the aligned legs of a third T connector 42 to the product container 11. The end of supply branch 43 opposite the third T connector 42 communicates with the interior of the container as by engaging a tubular pin or needle (not shown) disposed generally in the upper portion of the container 11 and opening into the interior thereof. Connected to the opposite aligned leg of the third T connector 42 is the applicator air supply line 24 which extends through the handle of spray gun 18, as previously described.

Intermediately disposed in the reservoir pressure supply branch 43 is a one-way air valve 44 of the type to allow free air movement in one direction while restricting air movement in the opposite direction. As disposed in the reservoir air supply branch 43, valve 44 is orientated to allow flow of air under pressure into the container 11 from the main air line 28 but operable to prevent air from flowing back through the branch 43 from the container 11.

In the use of the spray system, spray product is stored in the container 11. Compressor 25 pressurizes the spray system to the predetermined high limit. Upon engagement of the trigger 23 of the spray gun 18 by the operator, air and spray product are concurrently discharged from the nozzle. The air mixes with and atomizes the spray product to form a fine, particulate, uniform spray. Air in the container 11 does not back up through the branch 43, whereby an erratic pressure fluctuation is not experienced by the spray product in the container.

A specific embodiment of a spray applicator employing a fluid dispensing apparatus of the invention is shown in FIG. 2 and is fashioned for convenience as a spray gun 47 having an outer housing with a handle portion 48 and a barrel 49. A multiple fluid dispensing apparatus 51, according to the present invention, is installed in gun 47 to provide for the coordinated discharge of fluids therethrough. Apparatus 51 is constructed to provide stages or sequential initiation and termination of a first and second fluid or, in particular, a spray product and air through the spray gun 47. A casing or housing 52 of the apparatus 51 is cylindrical and is centrally located in handle 48, being secured in position by suitable struts 53, as shown in FIG. 3, extending from the interior walls of handle 48. Casing 52 has interior walls defining an interior chamber 55 having separate inlet means and outlet means for a plurality of fluids or, specifically, for air and a liquid spray product. For each fluid inlet there is a corresponding fluid outlet thus comprising a plurality of fluid inlet-outlet pairs. Spray product line 17, entering the bottom of handle 48, engages a fluid or liquid inlet port 56 on casing 52 opening into chamber 55, as by snugly engaging an open nipple associated with the port 56. Likewise, air line 24 enters the bottom of handle 48 and engages an open nipple associated with a fluid or air inlet port 57 spaced from liquid inlet port 56. A liquid line 59 leads from a liquid spray product outlet port 60 from chamber 55 to a mixing chamber 61 afforded by a suitable spray nozzle 63 having spray orifice 62 and threaded into the end of barrel portion 49 of applicator 47 to establish fluid communication between the fluid outlet means and spray nozzle 63. A pair of flexible, tubular air lines 64, 65 extend from a pair of open nipples integral with a pair of circumferentially aligned air outlet ports 67, 68 in communication with chamber 55 of casing 52. Air lines 64, 65 extend to and open into mixing chamber 61 to establish fluid communication between the air outlet means and the spray nozzle. Movably located in chamber 55 is a valving element 71 having first and second fluid passages or conduits for establishing communication between the air inlet and outlet ports and the liquid spray product inlet and outlet ports, respectively. Valving element 71 located in chamber 55 is sequentially movable between a first position in blocking relationship to the spray product inlet and outlet ports, and in blocking relationship to the air inlet and outlets shown in FIG. 5; a second position in blocking relationship to the spray product inlet and outlet, but with the first fluid conduit allowing fluid communication between the air inlet and air outlets, shown in FIG. 4; and a third position with the second fluid conduit allowing fluid communication between the spray product inlet and outlet and with the first fluid conduit allowing fluid communication between the air inlet and outlets, shown in FIG. 3.

Referring to FIGS. 3 through 5, valving element 71 is comprised as a linear plunger or spool having a plurality of spaced apart, aligned cylindrical heads 72, 73 and 76, with outer walls with portions in sealing relationship to the interior walls of the chamber 55. The heads are relatively spaced apart to provide passages or fluid conduits to accomplish, in conjunction with the spacing of the various ports, the aforementioned staging or sequential fluid discharge. A first head 72 is located at the interior end of valving plunger 71 and is movable into and out of blocking relationship relative to the air inlet port 57 and air outlet ports 67, 68. A second head 73 is connected in aligned relationship to the first head 72 by a first neck 74, and is movable into and out of blocking relationship between the spray product inlet port 56 and the spray product outlet port 60. The neck 74 connected to heads 72 and 73 has a reduced diameter and outer walls spaced from the interior walls of the chamber 55, thus providing a first fluid conduit or passage through the chamber 55. A third head 76 is spaced from the second head 73 and connected to it by a second neck 77. Second neck 77 is likewise reduced in diameter and provides a second fluid conduit or passage through the chamber 55. An actuator or shaft 78 extends from the third head 76 outward of the chamber 55 through a suitable aperture 80 wherein there is provided usual and preferred sealing means to prevent leakage. The various heads 72, 73, 76 have outwardly projected circumferential ridges 81 which contact the interior walls of the chamber 55 and provide the necessary sealing relationship to achieve isolation of the fluid passages through valve chamber 55.

Plunger 71 is movable between three operative positions in chamber 55. In a first or closed position, as shown in FIG. 5, first head 72 blocks fluid communication between air inlet port 57 and air outlet port 67 as by blocking air outlet port 67. Second head 73 prevents fluid communication between the spray product inlet port 56 and the spray product outlet port 60 by blocking both ports, as shown, although, it is apparent that it is necessary only to block one of the ports. Plunger 71 is linearly movable from a first position shown in FIG. 5 to an intermediate position of FIG. 4 wherein the first head 72 is moved out of blocking relationship to the air outlet port 67. An isolated passage or conduit of fluid communication is established between the air inlet port 57 and air outlet port 67 around the first neck 74. The passage thus formed is isolated from other ports and from other portions of the chamber whereby mixture of the fluid passing therethrough with other fluids is prevented. Upon the formation of such passage, air flow is initiated. Second head 73 remains in blocking relationship to spray product outlet port 60. On further linear movement of plunger 71 in chamber 55, the position shown in FIG. 3 is achieved. A fluid conduit or passage remains established between air inlet port 57 and air outlet port 67 around the first neck 74. A second isolated fluid conduit or passage is established between the spray product inlet port 56 and the corresponding spray product outlet 60 around the second neck 74 as second head 73 is moved out of blocking relationship to the spray product outlet port 60. Spray product flow is initiated. As shown in FIG. 3, second head 73 is in a position to prevent mixture of air and spray product in the chamber 55. With the valving plunger 71 in the position of FIG. 3, air and spray product are concurrently discharged, the air progressively mixing with and atomizing the spray product to provide a fine, particulate spray outside of apparatus 51. Upon termination of spraying, movement of plunger 71 in chamber 55 is reversed, going respectively through the sequence of FIGS. 3, 4 and 5. The flow of spray product is first shut off when the second head 73 blocks the spray product outlet port 60 in the position of FIG. 4. Finally, the air flow is also shut off when the plunger 71 reaches the position of FIG. 5, as previously explained. The staging of the air and spray product flow is accomplished by the relative sizing and spacing of the first and second heads 72, 73, as well as the relative spacing of various ports. It is apparent that these parameters may be varied to vary the degree of staging or to cause simultaneous initiation and termination of discharge of the various fluids through the various fluid ports. It is further apparent that additional fluid conduits could be introduced into the valve and coordinated as desired with the present fluid conduits.

As shown in FIGS. 3 through 5, the inlet ports 56, 57 are not located on casing 52 diametrically opposite the respective outlet ports 60, 67, 68, but rather are staggered. In the closed position of FIG. 5, the liquid inlet port 56 is partially open to the chamber 55 to permit liquid lubrication about the second neck 77. Air port 57 is open to the chamber 55 to permit even distribution of air pressure around the first head 72.

Referring again to FIG. 2, linear movement of plunger 71 in chamber 55 is controlled by linear movement of plunger shaft 78 linearly extending from the third head 76 and second neck 77. Plunger shaft 78 extends outward from the chamber 55 and outward of the gun handle 48 and is attached at one end to a trigger 83. The upper end of trigger 83 is guided for linear movement in a suitable channel 84. Bias means comprised as a helical compression spring 85 surrounds the outward portion of shaft 78 between trigger 83 and gun handle 48 to bias valve plunger 71 in the outermost or closed position. Digital pressure on trigger 83 is operative to actuate dispensing apparatus 51 to provide the coordinated dispersing of a multiple of fluids.

The spray applicator 47 allows the spray operator to alternate between a fine and a more coarse spray. Air outlet means on the casing 52, as previously noted, includes a pair of outlet ports 67, 68 which are joined respectively to a pair of air lines 64, 65, of which at least one is comprised of a flexible tubing. The flexible tubular air line 65 extends upward from casing 52 and then extends forwardly to the mixing chamber 61. A portion of the air line 65 passes over a ledge 87 extending inward from a vertical wall of applicator 47 near the top of barrel portion 49. A button 88 located exteriorly of barrel 49 has a shaft 89 passing through an aperture provided in the barrel 49, and terminates in a plate 91. A portion of the air line 65 is sandwiched between the plate 91 and the ledge 87. Application of digital pressure downward on the button 88 results in the pinching off of the air line 65 cutting the flow of air to the mixing chamber by approximately ½. The resultant spray is more coarse.

In the use of the applicator 47, the operator simply engages the trigger 83. As the shaft 78 moves the plunger 71 interiorly of the chamber 55, the air and liquid product sprays are automatically staged. Likewise, upon termination of spraying, simply by release of the trigger 83 the termination of the air and liquid sprays is staged. The spring 85 returns the plunger 71 to the closed position. Pneumatic pressure developed in the interior end of chamber 55 upon inward movement of plunger 71 also biases the plunger toward a closed position.

The fluid dispensing apparatus of the invention has been illustrated as it is particularly applicable to spray applicators although the apparatus lends itself to many diverse uses in the dispensing of a multiple of fluids, as will be recognized by those skilled in the art. For example, such an apparatus is usable in coin operated beverage dispensing machines for mixing carbonated water with one of a choice of several soft drink syrups. The apparatus may have two or more fluid inlets to admit a plurality of differing fluids, and a corresponding number of fluid outlets. The relative spacing of the fluid ports communicating with the chamber, as well as the relative sizing and spacing of the heads of the plunger, is determinative of the coordination of the discharge of the fluids.

The embodiments of the invention in which an exclusive property or privilege is claimed are defined as follows:

1. A multiple fluid dispensing apparatus comprising:

a casing having interior walls defining a longitudinal chamber having a closed interior end;

a plurality of longitudinally spaced fluid inlets to said chamber adapted to receive a plurality of separate fluids from separate fluid sources;

a plurality of longitudinally spaced fluid outlets from said chamber, a fluid outlet corresponding to each fluid inlet forming a plurality of fluid inlet-outlet pairs;

a linear plunger movably located in said chamber;

said plunger having a plurality of longitudinally spaced heads with portions in sealing engagement with said interior walls operable to block fluid flow between the inlet and outlet of each fluid inlet-outlet pair;

said plunger having a plurality of isolated fluid conduits located between said heads to permit fluid flow through said chamber, one fluid conduit corresponding to each fluid inlet-outlet pair;

said plunger being linerly movable in said chamber between a first position with said heads positioned in said chamber to block fluid flow between the inlet and outlet of each fluid inlet-outlet pair, and a second position with one of said fluid conduits located to permit fluid flow through said chamber between the fluid inlet and outlet of one fluid inlet-outlet pair, and a third position with said fluid conduits located in said chamber to permit fluid flow through said chamber between the fluid inlets and outlets of at least two inlet-outlet pairs to provide coordinated discharge of the fluids from the apparatus;

said plunger being longitudinally movable in said chamber from said first position toward the other positions in a direction toward said closed interior end whereby pneumatic pressure developed in said interior end biases said plunger back toward said first position; and actuator means to actuate movement of the plunger in the chamber.

2. the apparatus of claim 1 including: bias means on said actuating means to bias said plunger in the first position.

3. The apparatus of claim 1 wherein: said plunger has a plurality of necks connecting said heads and providing said fluid conduits.

4. The apparatus of claim 3 wherein; said heads on said plunger are relatively spaced to effect sequential initiation and termination of flow through the fluid conduits and fluid inlet-outlet pairs upon movement of the plunger in the chamber.

5. A multiple fluid dispensing apparatus comprising:

a casing having smooth interior walls defining a generally cylindrical chamber;

a plurality of fluid inlet ports to said chamber adapted to receive a plurality of separate fluids;

a plurality of fluid outlet ports from said chamber, at least one fluid outlet port corresponding to each fluid inlet port;

a plunger slidably movably located in said chamber;

said plunger having a plurality of spaced apart heads having side walls movable with said plunger into and out of blocking relationship between corresponding fluid inlet and outlet ports;

said plunger movable in a first direction from a position with said heads in blocking relationship between corresponding fluid inlet and outlet ports toward positions permitting fluid flow between corresponding fluid inlet and outlet ports;

said plunger having a plurality of necks connecting said heads and providing isolate fluid conduits between corresponding fluid inlet and outlet ports when said heads are in a position out of blocking relationship between corresponding fluid inlet and outlet ports;

said fluid outlets being longitudinally staggered in said first direction from corresponding fluid inlets in such fashion that the fluid inlets are at least partially open to corresponding fluid conduits when said heads are in blocking relationship to the fluid outlets;

said heads having outwardly projected circumferential, spaced apart ridges which contact the smooth interior walls of the chamber in sealing relationship to achieve isolation of said fluid conduits; and actuator means connected to said plunger to actuate movement of said plunger into and out of blocking relationship between corresponding fluid inlet and outlet ports.

6. The apparatus of claim 5 wherein: said plurality of inlet ports includes at least a first inlet port and a second inlet port; said plurality of fluid outlet ports including at least a first outlet port corresponding to the first inlet port and a second outlet port corresponding to the second inlet port; said plunger having a first head movable into and out of blocking relationship between said first inlet port and said first outlet port, a first neck in linear alignment with said first head and providing a first fluid conduit for fluid communication between the first inlet and outlet ports, a second head in linear alignment with said first neck and movable into and out of blocking relationship between the second fluid inlet port and said second fluid outlet port, and a second neck in linear alignment with said second head and providing a second fluid conduit for fluid communication between the second inlet and outlet ports.

7. The apparatus of claim 5 including: bias means associated with the actuator means to bias the plunger with said heads in blocking relationship between corresponding inlet and outlet ports.

8. The apparatus of claim 5 wherein said actuator means to actuate the plunger includes: a plunger shaft extending from said plunger linearly outward of said chamber and casing, and a trigger connected to the outward end of said plunger whereby digital pressure upon said trigger is operable to move said plunger between positions having said heads in and out of blocking relationship between corresponding inlet and outlet ports.

9. A multiple fluid dispensing apparatus comprising:

a casing having interior walls defining a longitudinal, generally cylindrical chamber;

fluid inlet means to said chamber adapted to be connected to separate fluid sources and including first fluid inlet means and second fluid inlet means;

fluid outlet means from the chamber corresponding to the fluid inlet means and including a first fluid outlet means from the chamber and a second fluid outlet means from the chamber;

a valving element movably located in the chamber;

said valving element having a plurality of spaced apart heads movable into and out of blocking relationship relative to said fluid outlet means to selectively permit fluid flow and block fluid flow from said chamber through said outlet means;

said valving element having a first fluid passage and a second fluid passage separated by a first of said heads;

means on said first head movable therewith making sealing engagement with the chamber walls to isolate said first and second fluid passages;

said first fluid inlet means being longitudinally staggered relative to the first fluid outlet means whereby with a first head of the valving element in blocking relationship to the first outlet means, the first inlet means is at least partially open to said first fluid passage;

said second fluid inlet means being longitudinally staggered relative to the second fluid outlet means whereby with a second head of the valving element in blocking relationship to the second outlet means, the second inlet means is at least partially open to said second fluid passage;

said valving element sequentially movable between a first position with the first head blocking the first fluid outlet means, and the second head blocking the second fluid outlet means;

a second position with the first fluid passage allowing fluid communication between the first fluid inlet means and the first fluid outlet means, and the second head blocking the second fluid outlet means;

a third position with the first fluid passage allowing fluid communication between the first fluid inlet means and the first fluid outlet means, and the second fluid passage allowing fluid communication between the second fluid inlet means and the second fluid outlet means;

said valving element movable in said chamber in a first direction from said first position to said second positon to said third position;

said first and second outlet means being longitudinally staggered respectively from said first and second inlet means in said first direction relative to the chamber; and actuator means adapted to sequentially move said valving element in the chamber between said positions.

10. The apparatus of claim 9 wherein: said first fluid outlet means includes a pair of fluid outlet ports communicating with the chamber; and including means to selectively restrict the flow of a first fluid through one of said first fluid outlet ports.

11. The apparatus of claim 9 including: bias means associated with the actuator means to bias said valving element in the first position.

12. The apparatus of claim 9 wherein: said valving element is constituted as a plunger linearly movable in said chamber; said plunger having said first head movable into and out of blocking relationship relative to said first outlet means, a first neck in linear alignment with said first head and providing said first fluid passage; said second head being in linear alignment with said first neck and movable into and out of blocking relationship relative to said second fluid outlet means, and a second neck in linear alignment with said second head and providing said second fluid passage.

* * * * *

UNITED STATES PATENT AND TRADEMARK OFFICE

CERTIFICATE OF CORRECTION

PATENT NO. : 3,937,253

DATED : February 10, 1976

INVENTOR(S) : Duane F. Lilja

It is certified that error appears in the above-identified patent and that said Letters Patent are hereby corrected as shown below:

Column 1, line 13, "discharged" should be --discharge--.

Column 1, line 34, "coordinate" should be --coordinated--.

Column 2, line 6, "spary" should be --spray--.

Column 2, line 28, "in" should be --is--.

Column 3, line 54, "stages" should be --staged--.

Column 7, line 6, "linerly" should be --linearly--.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*